US010837648B1

(12) United States Patent
Lapeyre et al.

(10) Patent No.: US 10,837,648 B1
(45) Date of Patent: Nov. 17, 2020

(54) OUTDOOR COOKER WITH IMPROVED COOLING ARRANGEMENT

(71) Applicants: Robert S. Lapeyre, New Orleans, LA (US); Robert T. Lapeyre, New Orleans, LA (US)

(72) Inventors: Robert S. Lapeyre, New Orleans, LA (US); Robert T. Lapeyre, New Orleans, LA (US)

( * ) Notice: Subject to any disclaimer, the term of this patent is extended or adjusted under 35 U.S.C. 154(b) by 624 days.

(21) Appl. No.: 15/462,127

(22) Filed: Mar. 17, 2017

(51) Int. Cl.
*F24C 3/14* (2006.01)
*F24C 3/02* (2006.01)

(52) U.S. Cl.
CPC . *F24C 3/14* (2013.01); *F24C 3/02* (2013.01)

(58) Field of Classification Search
CPC .. F28F 1/003; F62C 3/065; F62C 3/00; F62C 3/02; F62C 3/004; F62C 3/006; F62C 3/008; F62C 3/0214; F62C 3/0264
USPC ..... 165/169, 115, 101; 126/380.1
See application file for complete search history.

(56) References Cited

U.S. PATENT DOCUMENTS

| | | | | |
|---|---|---|---|---|
| 2,184,380 | A | 12/1939 | Deibel | |
| 2,538,015 | A | 1/1951 | Kleist | |
| 2,555,230 | A | 5/1951 | Ford | |
| 2,785,545 | A | 3/1957 | Pusey | |
| 2,800,776 | A | 7/1957 | Woodmansee | |
| 3,882,639 | A | 5/1975 | Kollbach | |
| 4,124,994 | A | 11/1978 | Cornelius et al. | |
| 6,185,942 | B1 | 2/2001 | Werrbach, III et al. | |
| 6,431,164 | B1 | 8/2002 | Wardell | |
| 7,640,848 | B1 * | 1/2010 | Bourgeois | A47J 27/04 99/340 |
| 9,833,796 | B2 | 12/2017 | Bourgeois | |
| 9,927,185 | B1 * | 3/2018 | Boyd, IV | F28F 1/003 |
| 2013/0092757 | A1 * | 4/2013 | Breault | F16L 3/1083 239/273 |

(Continued)

OTHER PUBLICATIONS

The Viking Corporation, Technical Data for Water Spray Design, The Viking Corporation, 210 N. Industrial Park Drive, Hastings, MI 49058, Replacement pp. 208a-208o, Apr. 17, 2009, available at http://www.vikinggroupinc.com/sites/default/files/databook/deluge/designdata/042602.pdf.

(Continued)

*Primary Examiner* — Vivek K Shirsat
(74) *Attorney, Agent, or Firm* — Garvey, Smith & Nehrbass Patent Attorneys, L.L.C.; Charles C. Garvey, Jr.; Vanessa M. D'Souza

(57) ABSTRACT

An outdoor cooking apparatus provides a base that has a burner element and one or more feet configured to engage an underlying support surface. The base includes a pot receptive grate or pot support. A pot is placeable on the base during cooking so that the burner heats the contents of the pot. The pot has a pot side wall or walls, a pot bottom, a pot rim, a pot outer surface, and a pot interior for holding a volume of cooking fluid. A pot liner or basket fits the pot interior, the liner sized and shaped to hold one or more food items to be cooked. The combination of base and pot support a water spray ring or header with a hollow bore, a wall, and multiple discharge openings in the wall that enable water to spray the pot exterior with multiple flow streams or sprays. An inlet fitting enables connection of a flowing source of water to the header or ring bore. The header or ring is so positioned that the pot liner can be removed from the pot interior without first moving the header or ring.

40 Claims, 17 Drawing Sheets

(56) References Cited

U.S. PATENT DOCUMENTS

2015/0096317 A1 4/2015 Bourgeois

OTHER PUBLICATIONS

Mike Izbicki, The External Wort Chiller, Izbicki.me blog, Jul. 24, 2013, available at https://izbicki.me/blog/the-external-wort-chiller.html.

* cited by examiner

OUTDOOR COOKER WITH IMPROVED COOLING ARRANGEMENT

CROSS-REFERENCE TO RELATED APPLICATIONS

Not applicable

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to an improved outdoor cooking apparatus wherein a base supports a liquid containing pot having a food containing liner or basket and a burner fueled with a gaseous fuel (e.g., propane), and wherein after a selected food item or items are cooked, the pot liner and food items are rapidly cooled with a specially configured water sprayer that enables a user to cool the cooking liquid and contained food item (e.g., crabs, lobster, crayfish (or crawfish)) until a desired temperature is reached that stops, slows or rests the cooking process, and wherein the water sprayer does not hinder removal of the liner and contained food items.

2. General Background of the Invention

A common, commercially available outdoor cooking arrangement employs a base (e.g., welded steel) having a heating element that is fueled by propane or other gaseous fuel. Food items to be cooked are placed in a liner or basket that is then lowered into a pot with water and seasoning. The pot occupies a position upon the base and above the burner. Cooking typically involves heating the water, and bringing contained seasoning and food items (e.g., crayfish or crawfish, crabs, lobster) to boiling. Once cooking is complete, the burner is extinguished by closing a valve in a flow line that supplies the propane or other fuel to the burner. Such outdoor cooking devices can be purchased from Cabela's Outfitters (www.cabelas.com). An example is model or item number 1K-551305 known as "Cabela's Multi-Cooker Kit".

Because the pots can contain a large volume of water (e.g., 50-100 quarts), much time can be required to cool the pot, cooking fluid, and food items. For some food items, consumers prefer that the item be cooled to a temperature near ambient. Other consumers prefer that the food be warm or even very hot. Selective cooling is thus preferred to meet the needs or desires of numerous consumers.

The present invention enables the selective cooling of a food item and of the cooking water with added seasoning. The present invention enables cooling of the combination of cooking fluid, seasoning, and food items to a desired temperature (e.g., as monitored with a thermometer) be it ambient, warm, or hot. The desired temperature preferably stops, slows or rests the cooking process of the food items.

The following possibly relevant U.S. Patents and Publications are incorporated herein by reference:

| Pat. No. | Title | Issue Date MM/DD/YYYY |
|---|---|---|
| 2,184,380 | THERMAL EXCHANGE BARREL | Dec. 26, 1939 |
| 2,538,015 | LIQUID COOLER | Jan. 16, 1951 |
| 2,555,230 | PRESSURE COOKING PROCEDURE | May 29, 1951 |
| 2,785,545 | BULK MILK COOLER | Mar. 19, 1957 |
| 2,800,776 | WATER COOLER ATTACHMENT | Jul. 30, 1957 |
| 3,882,639 | JET SAND BLASTING OF BENT TUBES OR RODS | May 13, 1975 |
| 4,124,994 | BEVERAGE COOLING BATH | Nov. 14, 1978 |
| 6,185,942 | RAPID FOOD COOLING APPARATUS AND METHOD OF USE | Feb. 13, 2001 |
| 6,431,164 | WATER CIRCULATED GRILL WITH GRILL STEAMER AND STEAM POT | Aug. 13, 2002 |
| 7,640,848 | GAS FIRED OUTDOOR COOKING APPARATUS THAT INCLUDES POT WITH SPIGOT DRAIN | Jan. 5, 2010 |
| 2015/0096317 | SYSTEM AND METHOD FOR EVAPORATIVE COOLING OF A HEATED APPARATUS | Apr. 9, 2015 |

BRIEF SUMMARY OF THE INVENTION

The apparatus of the present invention includes a base having a burner element and one or more feet configured to engage an underlying support surface.

The base includes a pot receptive grate (e.g., multiple bars). A pot having a pot rim, pot side wall or walls, a pot outer surface, and a pot interior for holding a volume of cooking fluid is placed on the base and above the burner element.

The apparatus of the present invention includes a basket or pot liner that fits the pot interior, the liner being sized and shaped to hold one or more food items to be cooked. Such food items can be crayfish or crawfish, crabs, lobster or other such food items.

In one embodiment, the combination of base and pot support a water spray ring with a hollow ring bore, a ring wall, and multiple discharge openings in the ring wall.

An inlet fitting enables connection of a flowing source of water (e.g., hose connected to city water supply) to the ring bore.

The ring is so positioned that the pot liner can be removed from the pot interior without first moving the ring.

In one embodiment, the ring is removably attached to the pot rim. In another embodiment, the ring is permanently attached to the pot at the pot side wall, such as at the pot rim.

In one embodiment, a plurality of radially extending supports extend between the pot rim and the ring.

In one embodiment, the supports are pivotally or rotatably attached to the ring so that the ring can be adjustably fitted to pots of different diameters.

In one embodiment, the ring extends three hundred sixty degrees around the pot.

In one embodiment, the ring tracks a circular path.

In one embodiment, the ring has polygonal or multi-sided shape such as hexagonal, square or octagonal.

In one embodiment, the discharge openings are positioned to spray water upon the pot outer surface.

In another embodiment, the present invention provides a base that has a burner element and one or more feet configured to engage an underlying support surface.

In one embodiment, the base includes a pot receptive upper surface or grate that can include multiple grate bars.

A pot is used for cooking food items. The pot rests upon the base. The pot has a pot rim, a pot outer surface, a pot side wall or walls, a pot bottom and a pot interior for holding a volume of cooking fluid such as water seasoned with cooking spices.

A pot basket or liner fits the pot interior, the liner is preferably sized and shaped to hold one or more food items to be cooked (e.g. crayfish or crawfish, crabs, lobster or the like).

The combination of pot and base support a fluid conveying spray header that has a header wall, a header flow conveying bore, and multiple discharge openings through the header wall.

An inlet fitting enables connection of a source of water (e.g. conduit such as a hose connected to a municipal water supply) to the header bore.

The header is so positioned that the pot liner can be removed from the pot interior without having to move the header.

In one embodiment, the header is attached to the pot.

In one embodiment, the header is attached to the base.

In one embodiment, the header is attached to the base and extends around the pot side wall or walls.

In one embodiment, the header is in the form of a ring that extends three hundred sixty degrees around the pot during use.

In one embodiment, the header tracks a circular path.

In one embodiment, the header has a polygonal shape.

In one embodiment, the has discharge openings that are positioned to spray water upon the pot outer surface.

The present invention includes an outdoor cooking apparatus, comprising a base that has a burner element and one or more feet configured to engage an underlying support surface. The base can include a pot receptive grate. A pot can have a pot rim, a pot outer surface, a pot interior for holding a volume of cooking fluid. A pot liner can fit the pot interior, the liner can be sized and shaped to hold one or more food items to be cooked. The combination of base and pot can support a water spray ring with a hollow ring bore, a ring wall, and multiple discharge openings in the ring wall. An inlet fitting can enable connection of a flowing source of water to the ring bore. The ring is so positioned that the pot liner can be removed from the pot interior without first moving the ring.

In one embodiment, the ring can be attached to the pot rim.

In one embodiment, the invention can further comprise a plurality of radially extending supports that extend between the pot rim and the ring.

In one embodiment, the supports can be rotatably attached to the ring so that the ring can be adjustably fitted to pots of different diameters.

In one embodiment, the ring can extend three hundred sixty degrees around the pot during use.

In one embodiment, the ring can track a circular path.

In one embodiment, the ring can have a polygonal shape.

In one embodiment, the ring can be located at the pot rim.

In one embodiment, the ring can closely conform to and can be affixed to the pot side wall.

In one embodiment, the discharge openings can be positioned to spray water upon the pot outer surface.

The present invention includes an outdoor cooking apparatus, comprising a base that has a burner element and one or more feet configured to engage an underlying support surface. The base can include a pot receptive grate. A pot can have a pot rim, one or more pot side walls, a pot bottom, a pot outer surface, a pot interior for holding a volume of cooking fluid. A pot liner can fit the pot interior, the liner can be sized and shaped to hold one or more food items to be cooked. The combination of pot and base can support a fluid conveying spray header that has a header wall, a header flow conveying bore, and multiple discharge openings in said header wall. An inlet fitting can enable connection of a flowing source of water to the header bore. The ring is so positioned that the pot liner can be removed from the pot interior without first moving the ring.

In one embodiment, the header can be attached to the pot side wall.

In one embodiment, the header can be attached to the base.

In one embodiment, the header can extend around the pot side wall or walls.

In one embodiment, the header can be positioned below the pot.

In one embodiment, the header can track a circular path.

In one embodiment, the header can be entirely below the pot.

In one embodiment, the header can be positioned to spray the pot bottom.

In one embodiment, the header can be a ring affixed to the pot side wall.

The present invention allows for rapid cooling of a pot in order to stop/slow the cooking process of food items in the pot. The present invention helps prevent over cooking of food items being cooked in a pot.

The present invention allows for rapid cooling of boiling seafood being cooked in a pot, which causes the gasses/steam in the food items to contract, resulting in absorption or "sucking in" of the seasoning in the liquid. The food items will have increased flavor, increased food item yield, and makes the seafood or other food items juicier.

The present invention eliminates the risk of over cooking during the soaking process. Once the spray ring device is used to reduce the temperature of the items being cooked in a pot to below cooking temperature (about 150 degrees), one can soak the food items for as long as desired without over cooking the food items.

The present invention is able to serve cooked food items at a desired/targeted temperature, instead of having to wait for the food items to cool off on their own.

The present invention eliminates the need to use ice in cooling down boiling solution. One does not need to dilute a recipe in order to cool off the cooked food items.

The present invention allows for savings on seasoning. One does not need to add extra seasoning to compensate for the extra water (from ice) being added during the soaking process.

The present invention allows for greater accuracy of a recipe for a second batch since one is no longer adding an unknown amount of water (in the form of ice) to the recipe.

The present invention allows for time savings on the soaking process. The present invention improves productivity of the cooking process. The soaking process time is drastically reduced by the present invention, which can complete multiple batches much faster.

Crawfish/crayfish or other food items stay juicy when transferred to a table from a pot, basket or liner because the temperature is such that the juices are no longer steaming off the shellfish or food items.

The present invention includes a cooking pot cooling apparatus, comprising a holder that can support a manifold next to a pot, the pot having an interior, one or more side walls and a pot rim. The manifold can have discharging openings that direct water spray next to the pot. An inlet fitting on the manifold can enable connection of a flowing source of water to said manifold. The manifold can be so positioned that food items can be removed from the pot interior without first moving the manifold.

In one embodiment, the manifold can be attached to the pot rim.

In one embodiment, the holder comprises a plurality of radially extending supports that can extend between the pot rim and the manifold.

In one embodiment, the supports can be rotatably attached to the manifold so that the manifold can be adjustably fitted to pots of different diameters.

In one embodiment, the manifold can be positioned below the pot.

In one embodiment, the manifold can be entirely below the pot.

In one embodiment, the manifold can extends three hundred sixty degrees around the pot during use.

In one embodiment, the manifold can track a circular path.

In one embodiment, the manifold can have a polygonal shape.

In one embodiment, the manifold can have a square shape.

In one embodiment, the manifold can have a rectangular shape.

In one embodiment, the manifold can be located at the pot rim.

In one embodiment, the manifold can closely conforms to and can be affixed to the pot side wall.

In one embodiment, the discharge openings can be positioned to spray water upon the pot outer surface.

In one embodiment, the manifold can be positioned to spray the pot bottom.

In one embodiment, the water spray temperature drops from about 212 degrees F. to between about 140-175 degrees F. in a time period of about 1-10 minutes.

In one embodiment, the water spray temperature drops from about 212 degrees F. to between about 155-160 degrees F. in a time period of about 3-6 minutes.

In one embodiment, the clip end portion that attaches to the ring can extend more than about 180 degrees around.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
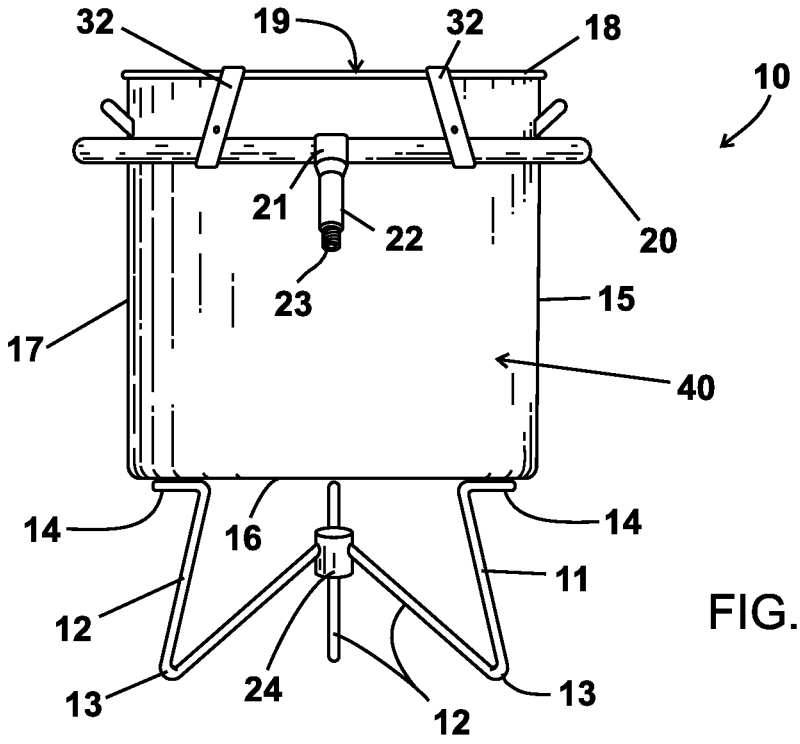
FIG. 1 is an elevation view of a preferred embodiment of the apparatus of the present invention.
Figure 2:
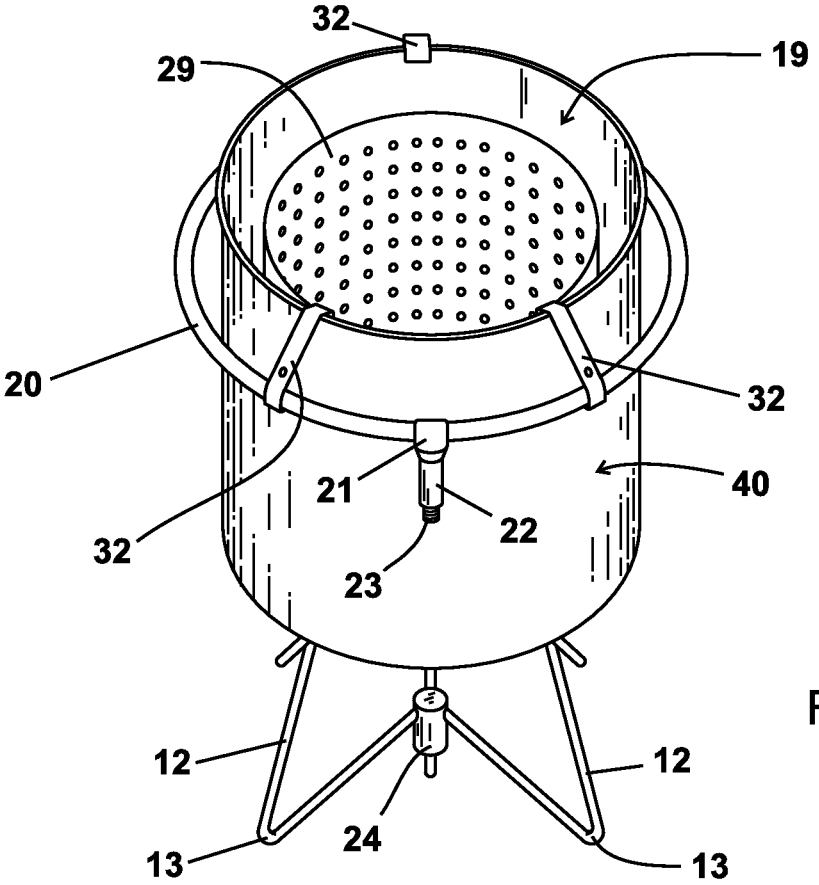
FIG. 2 is a perspective view of a preferred embodiment of the apparatus of the present invention.
Figure 3:
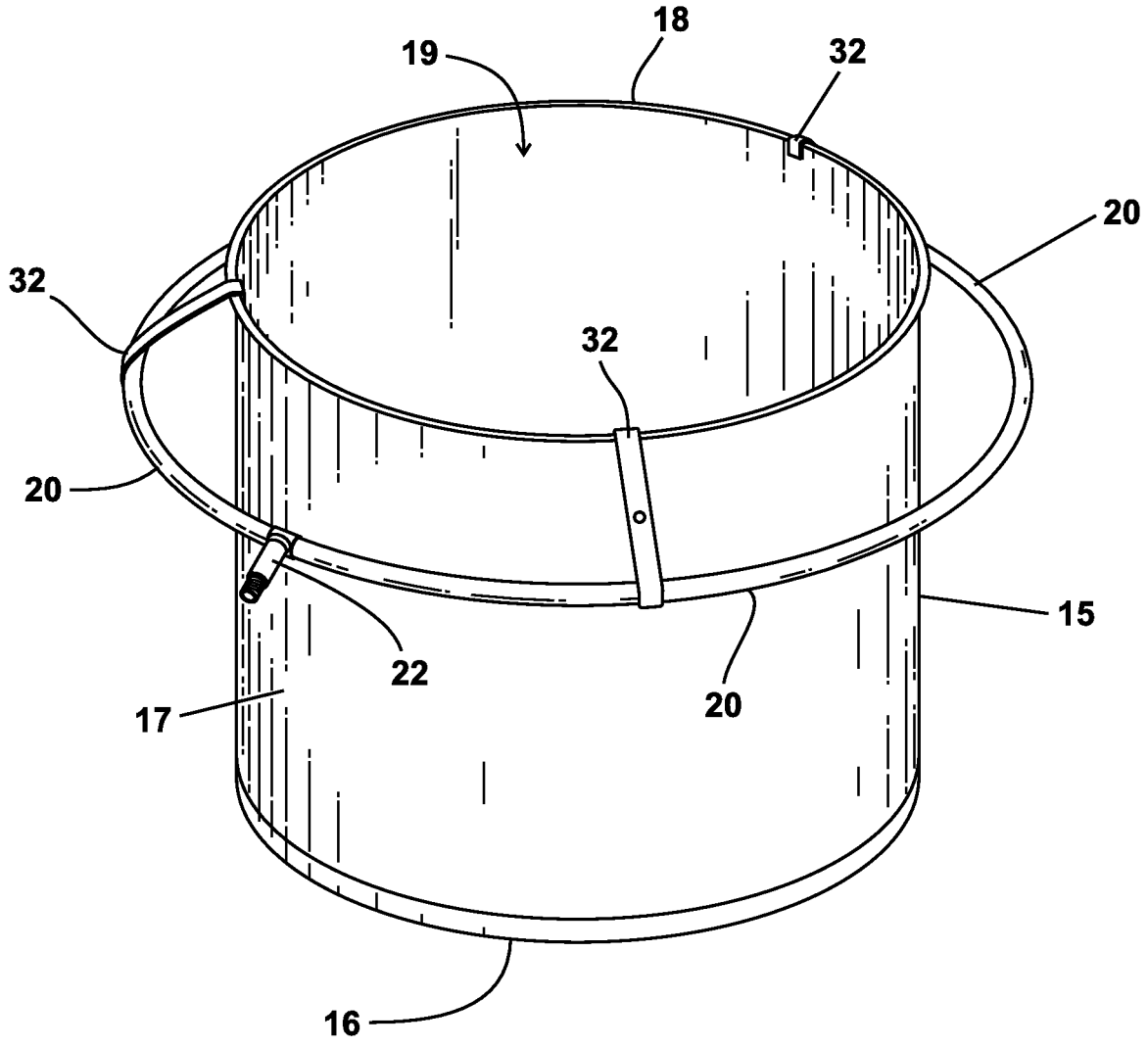
FIG. 3 is a partial perspective view of a preferred embodiment of the apparatus of the present invention.

FIGS. 1-11 show a preferred embodiment of the apparatus of the present invention, designated generally by the numeral 10. Outdoor cooking apparatus 10 includes a burner or base 11 having one or more legs 12. Legs 12 have one or more feet (or foot) 13 that engage an underlying support surface such as a concrete slab.

The base or burner apparatus 11 is provided with a commercially available burner element 24. At the upper end portion of base or burner apparatus 11, there is provided a pot support 14 which can be a plurality of horizontally extending bars that are welded to the legs 12. It should be understood that such a base/burner apparatus 11 is a commercially available unit known in the art (e.g., the aforementioned "Cabela's Multi-Cooker Kit").

Figure 4:
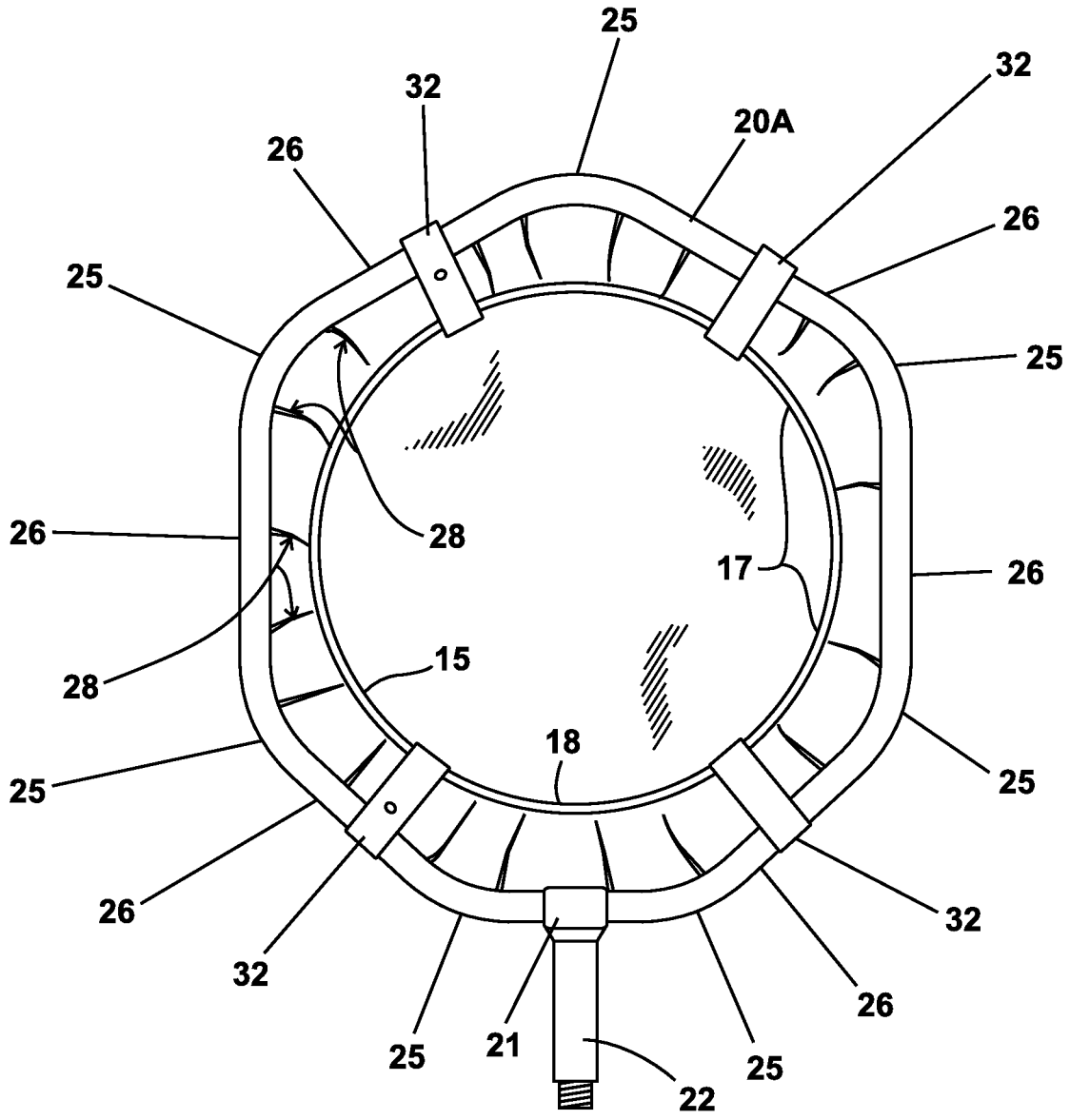
FIG. 4 is a partial top view of a preferred embodiment of the apparatus of the present invention.
Figure 5:
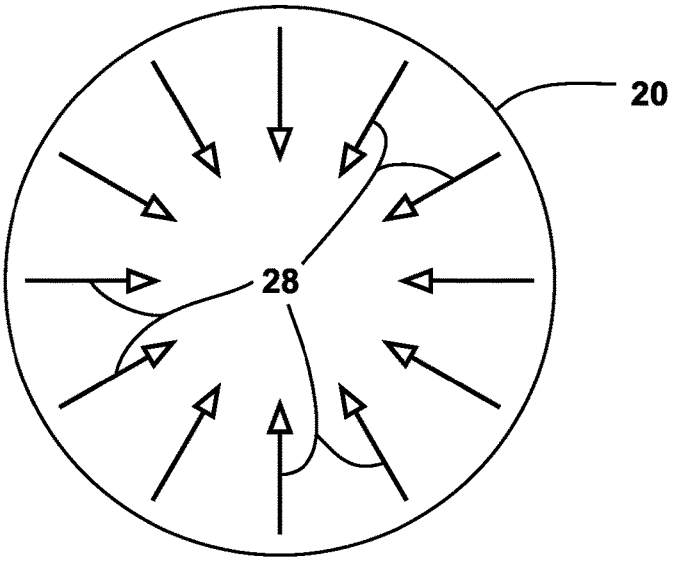
FIG. 5 is a partial, schematic top view of a preferred embodiment of the apparatus of the present invention.
Figure 6:
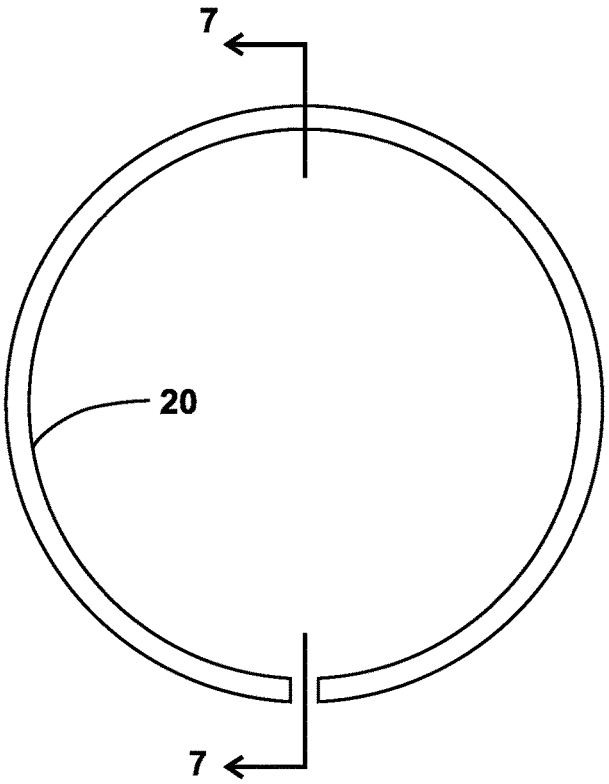
FIG. 6 is a top fragmentary view of a preferred embodiment of the apparatus of the present invention.
Figure 7:
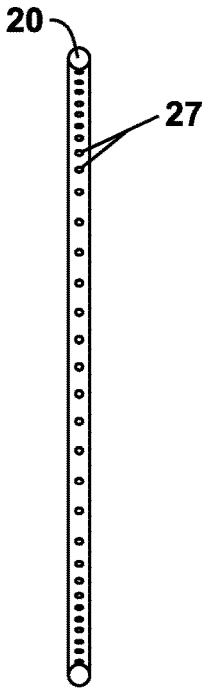
FIG. 7 is a sectional view taken along lines 7-7 of FIG. 6.
Figure 8:
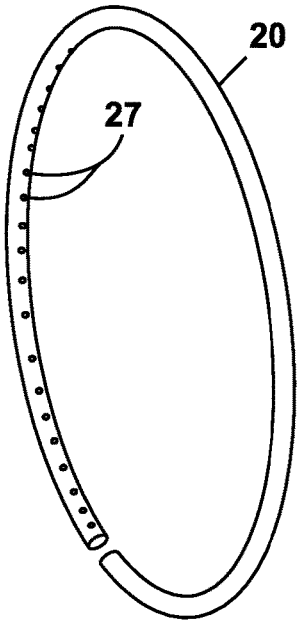
FIG. 8 is a partial perspective view of a preferred embodiment of the apparatus of the present invention.
Figure 9:
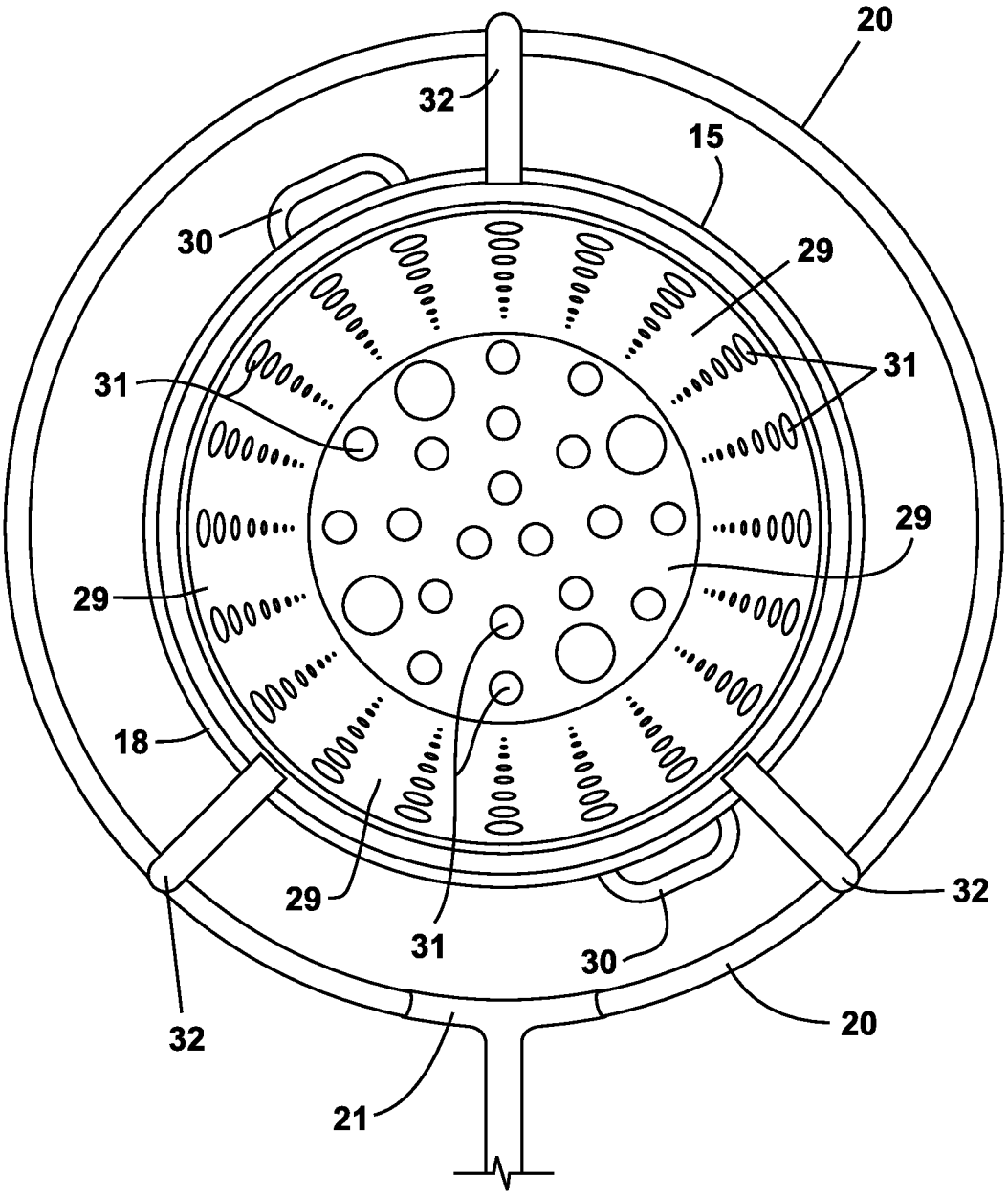
FIG. 9 is a partial plan view of a preferred embodiment of the apparatus of the present invention.
Figure 10:
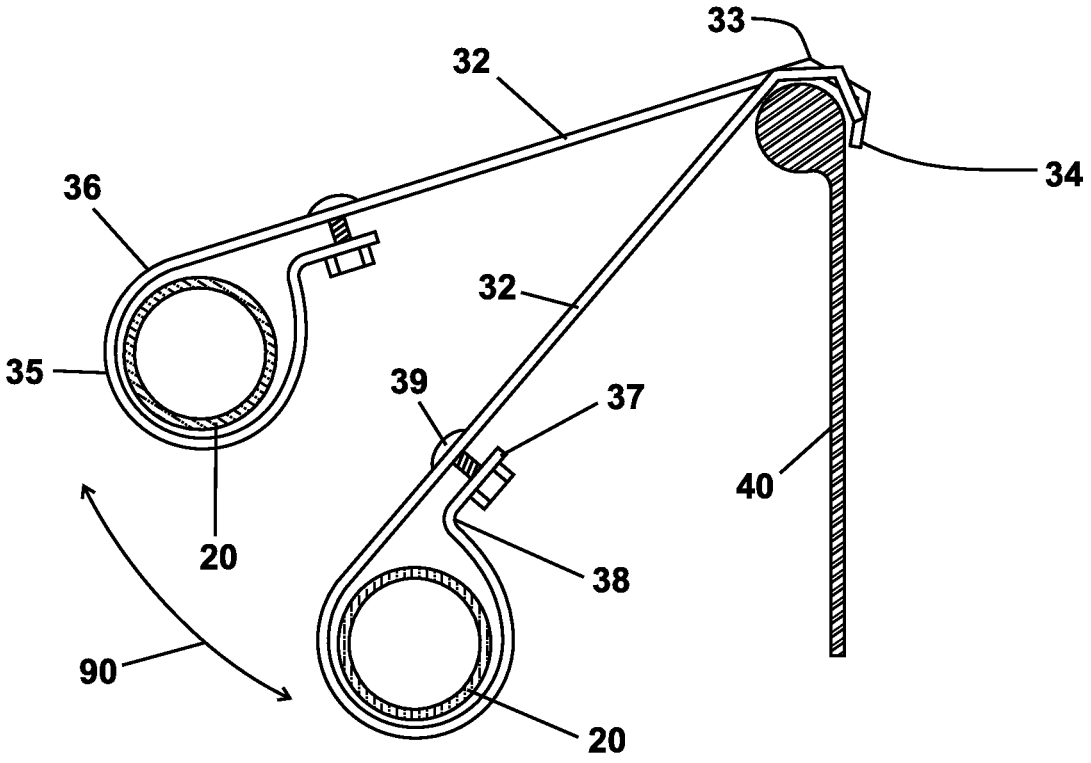
FIG. 10 is a fragmentary view illustrating the spray ring and ring supports of the apparatus of the present invention.
Figure 11:
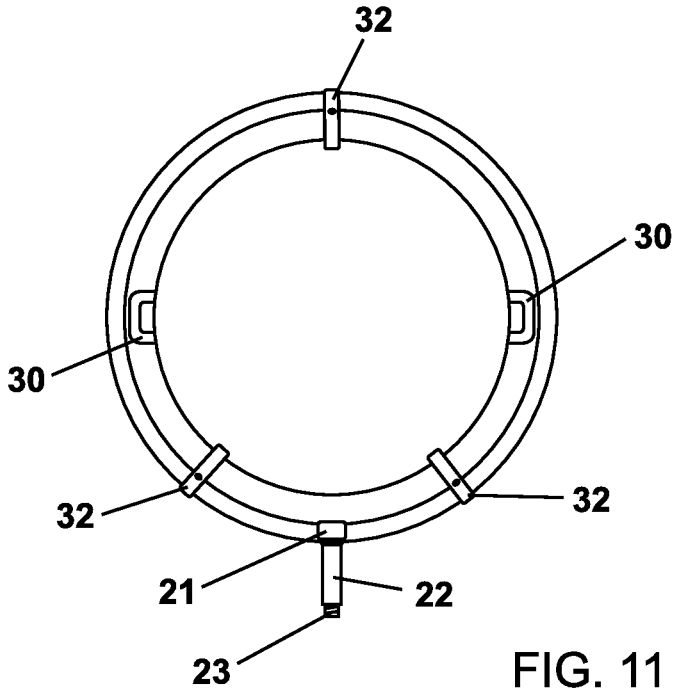
FIG. 11 is a partial top view of a preferred embodiment of the apparatus of the present invention.
Figure 18:
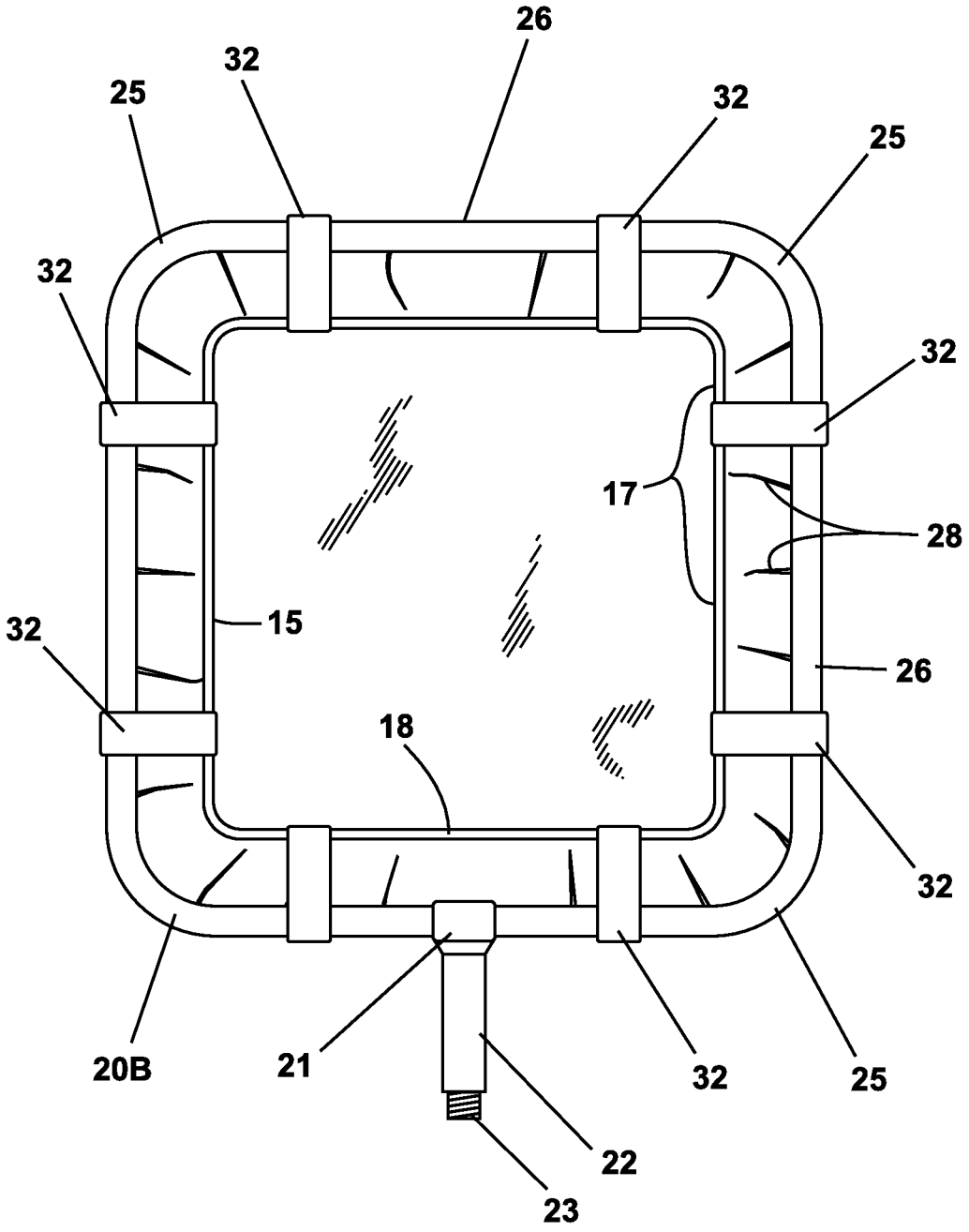
FIG. 18 is a partial top view of a preferred embodiment of the apparatus of the present invention.

Pot 15 can be seen in FIG. 1 resting upon the base or burner apparatus 11. Pot 15 provides a bottom panel 16 and side wall (or walls) 17. In one embodiment, pot 15 has at least one handle 30. At the upper end portion of side wall 17, there is provided a pot rim 18. The pot rim 18 surrounds a pot opening or open top 19. A spray ring 20 or 20A (as seen in FIG. 4) or 20B (as seen in FIG. 18) encircles pot 15 side wall 17. The spray ring 20, 20A or 20B can be supplied with ambient temperature or cooled water such as for example city water via a conduit or hose connected to fitting or tee 21.

The fitting or tee 21 joins to spray ring 20, 20A or 20B such as with a stab fitting, threaded or adhesive connection. Fitting or tee 21 has an inflow fitting 22 that can be a connector or connection, such as a threaded connection 23, for enabling easy connection to a selected source of water such as a flexible hose or garden hose that is in receipt of water from a city water supply (e.g., hose bib) or well.

The spray ring 20 can track a generally circular path. Alternatively, the spray ring 20A can have multiple bends 25 and multiple straight sections 26 to provide a polygonal shape as seen in FIG. 4. Alternatively, the spray ring 20B can have multiple bends 25 and multiple straight sections 26 to provide a square shape as seen in FIG. 18. Water spray openings are provided at 27. In the drawings, a water spray stream is indicated by the numeral 28 in FIGS. 4-5, 18.

A pot liner or basket 29 is sized and shaped to fit the pot interior. The basket or liner 29 can rest upon pot bottom panel 16. The liner or basket 29 is provided with a plurality of openings 31 that enable flow of cooking fluid into the basket and into contact with its food contents (e.g., lobster, crab, crayfish, crawfish, shrimp or the like).

A plurality of radially extending supports 32 can be used to support spray ring 20, 20A or 20B at a position that enables water spray upon pot 15 outer surface 40 for cooling the pot 15, its liquid cooking fluid, and the contents of the basket 29. Each radially extending support 32 has an inner end portion 33 and an outer end portion 35. The inner end portion 33 can be fitted with a hook or curved portion 34 that is shaped to engage pot rim 18 (see arrow 90). The outer end portion 35 provides a clamp 36. The clamp 36 can include an end 37 and a bend 38. Bolted connection 39 can be used to secure or clamp spray ring 20, 20A or 20B to each of the radially extending supports 32. A loosening of each bolted connection 39 enables the position of the radially extending support 32 to be changed, such as for example when fitting the spray ring 20, 20A or 20B to pots of differing diameters.

Figure 12:
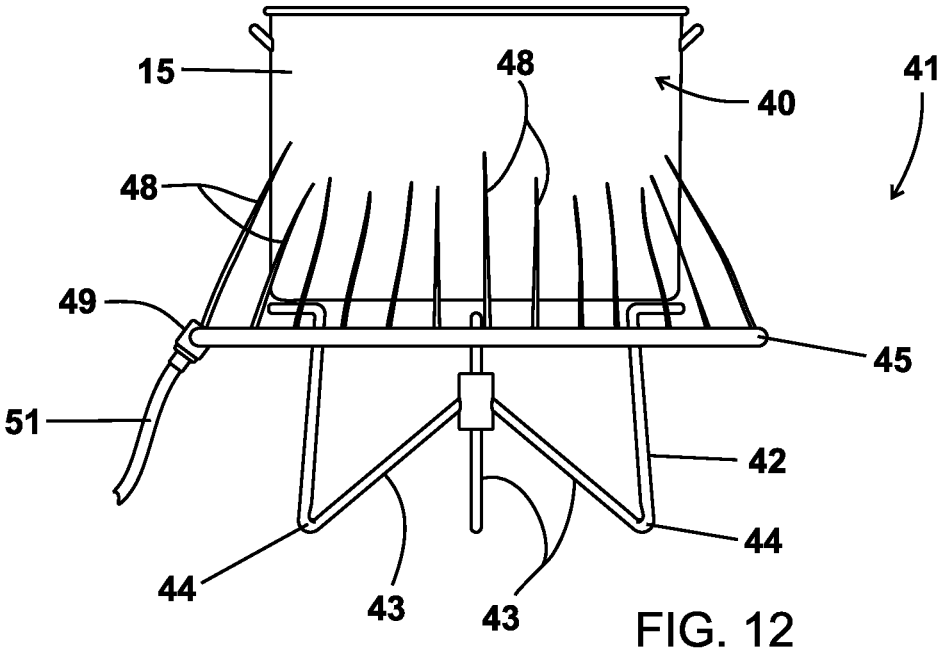
FIG. 12 is an elevation view of a second embodiment of the apparatus of the present invention.
Figure 13:
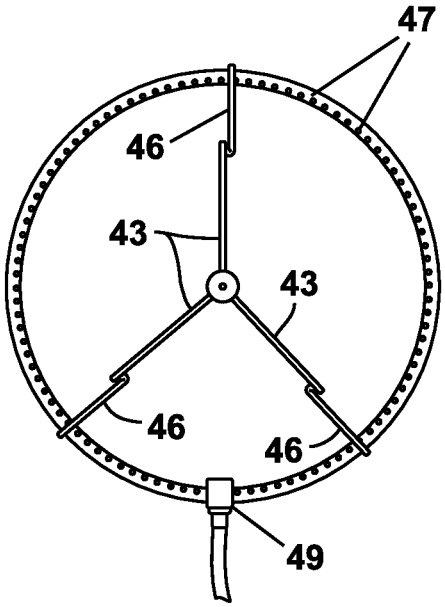
FIG. 13 is a partial plan view of a second embodiment of the apparatus of the present invention.

FIGS. 12-13 show a second embodiment wherein a spray ring or spray fitting 45 is attached to the burner base 42. In FIGS. 12-13, outdoor cooking apparatus 41 has base 42 having legs 43 and feet (or foot) 44 as well as a burner element. Spray ring 45 is attached to base 42 using radially extending supports 46. Supports 46 can be arms that are welded (or connected with fasteners) to base 42, such as to legs 43. Ring 45 has discharge openings 47 that enable water spray streams 48 to be directed to outer surface 40 of pot 15. As with the preferred embodiment mentioned supra, fitting 49 can be a tee that attaches to ring 45 and providing a connection for coupling to a hose 51 that conveys water from a source, such as city water, well or the like.

Figure 14:
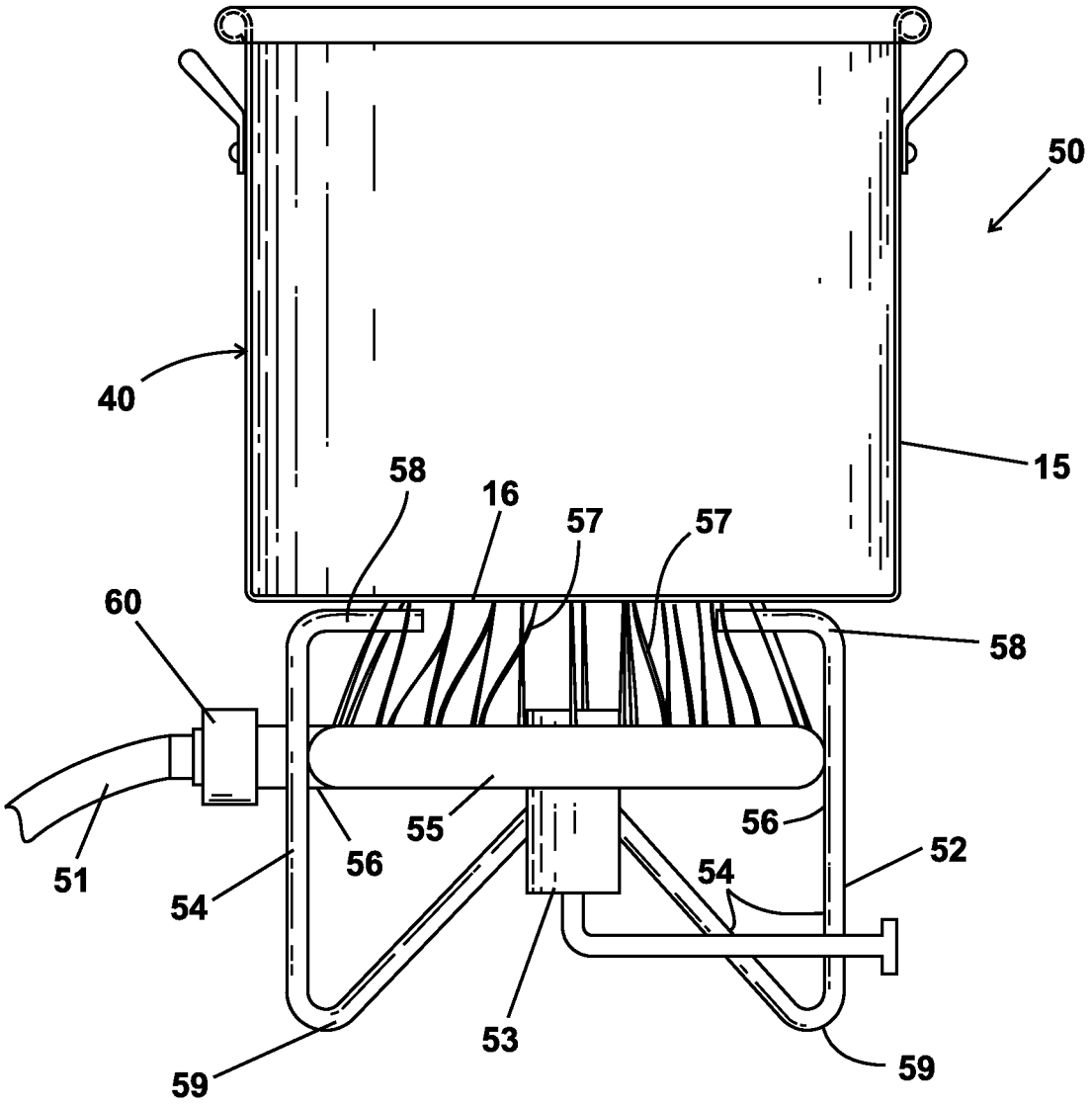
FIG. 14 is an elevation view of a third embodiment of the apparatus of the present invention.

In FIG. 14, there can be seen a third embodiment, designated generally by the numeral 50. In FIG. 14, outdoor cooking apparatus 50 has a base 52 with burner element 53. Base 52 has legs 54, feet 59, and a pot support or supports at 58. Spray ring 55 is connected to base 52 below pot 15 bottom panel 16. Attachments at 56 can be, for example, welded connections, fasteners or adhesive. Such connections or attachments 56 connect ring 55 to base 52 at legs 54.

As with the embodiments of FIGS. 1-13, a hose 51 can supply water from a well or city water system to spray ring 55 via fitting 60. As with the embodiments of FIGS. 1-13, spray ring 55 has discharge openings at spaced apart intervals (e.g., one inch apart). Such discharge openings enable multiple water spray streams 57 to contact outer surface 40 of pot 15 to effect a temperature reducing heat exchange. In FIG. 14, such water spray streams 57 can be directed to strike pot bottom panel 16.

Figure 15:
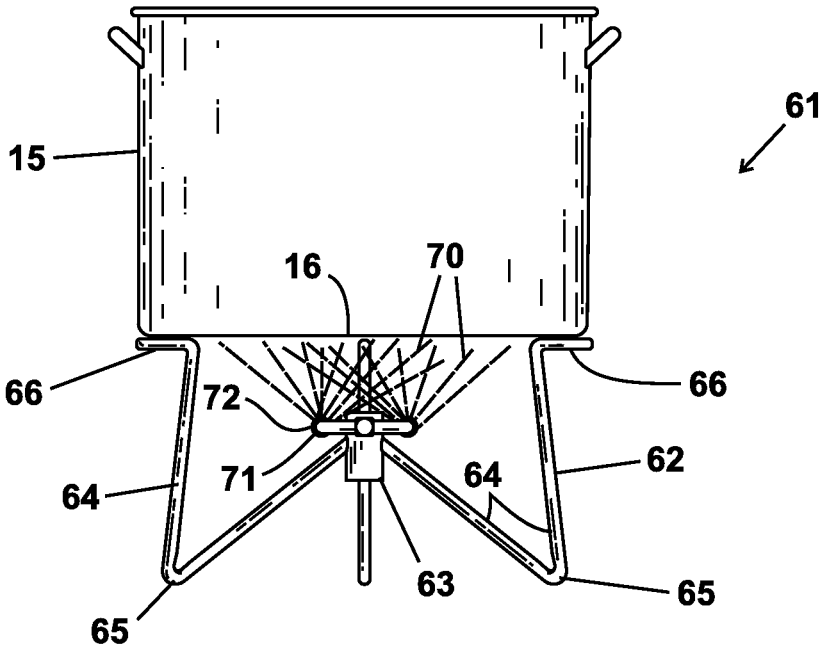
FIG. 15 is an elevation view of a fourth embodiment of the apparatus of the present invention.
Figure 16:
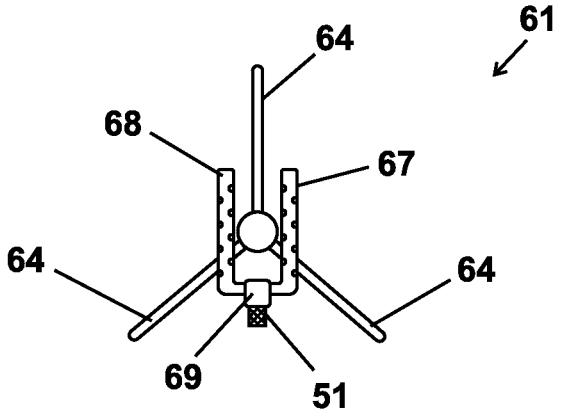
FIG. 16 is a fragmentary view of the embodiment of FIG. 15.

FIGS. 15-16 show a fourth embodiment of the apparatus of the present invention, designated generally by the numeral 61. Outdoor cooking apparatus 61 has base 62 with burner element 63. Base 62 has legs 64 and feet (or foot) 65 for engaging an underlying support such as a concrete driveway or patio. One or more pot supports 66 on base 62 enable a support of pot 15. Header 67 is attached to base 62, such as welded or fastened to one or more of the legs 64. Header 67 has an internal bore 72 surrounded by a header side wall 71. Discharge openings 68 in header 67 side wall 71 enable water spray streams 70 to be directed to pot 15 bottom panel 16. A fitting or tee 69 is connectable to a hose 51 and a water supply for transmitting water to header 67 and discharge openings 68. In FIGS. 15 and 16, water spray streams 70 are directed to spray water upon pot bottom panel 16.

Figure 17:
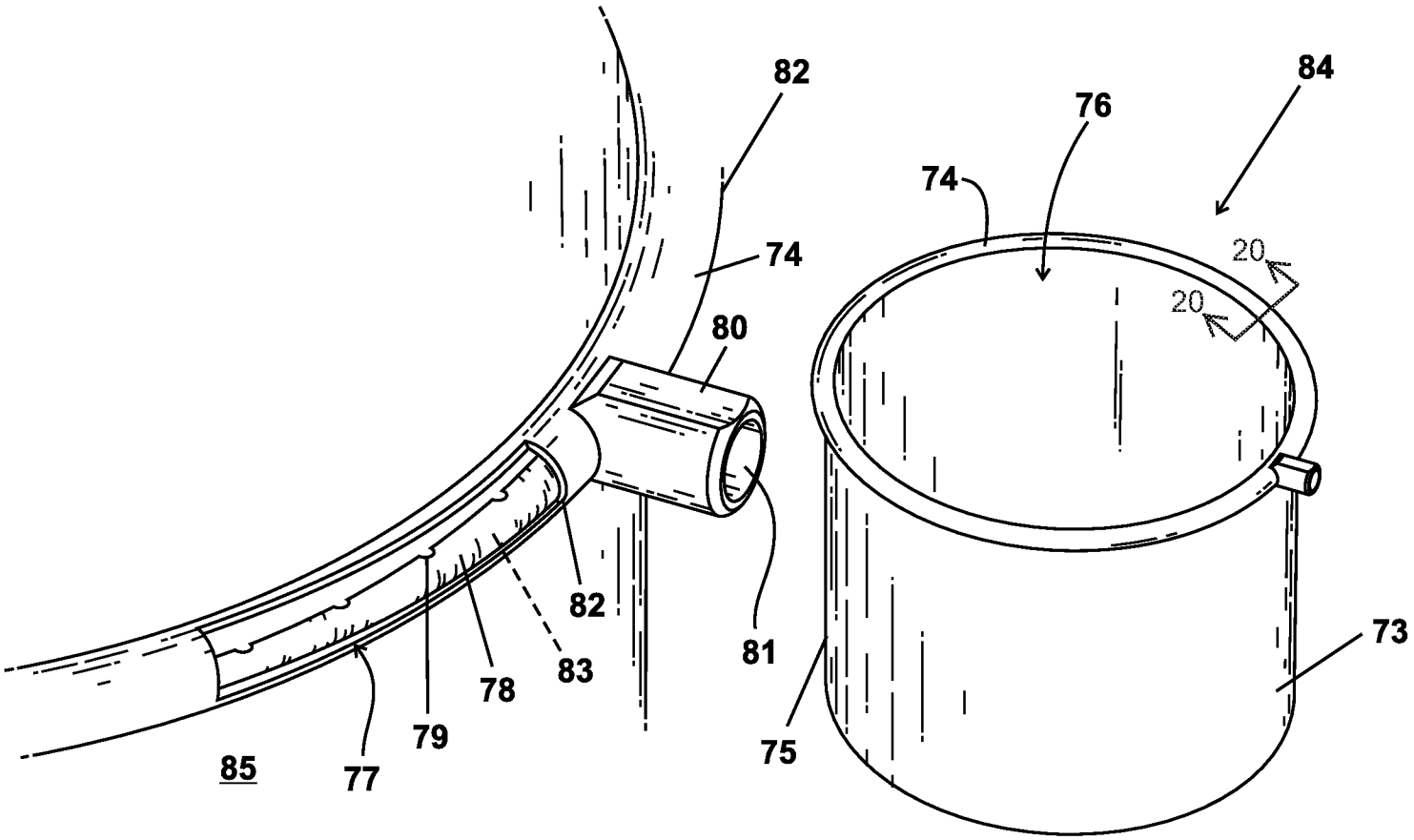
FIG. 17 is a perspective view of a fifth embodiment of the apparatus of the present invention.
Figure 20:
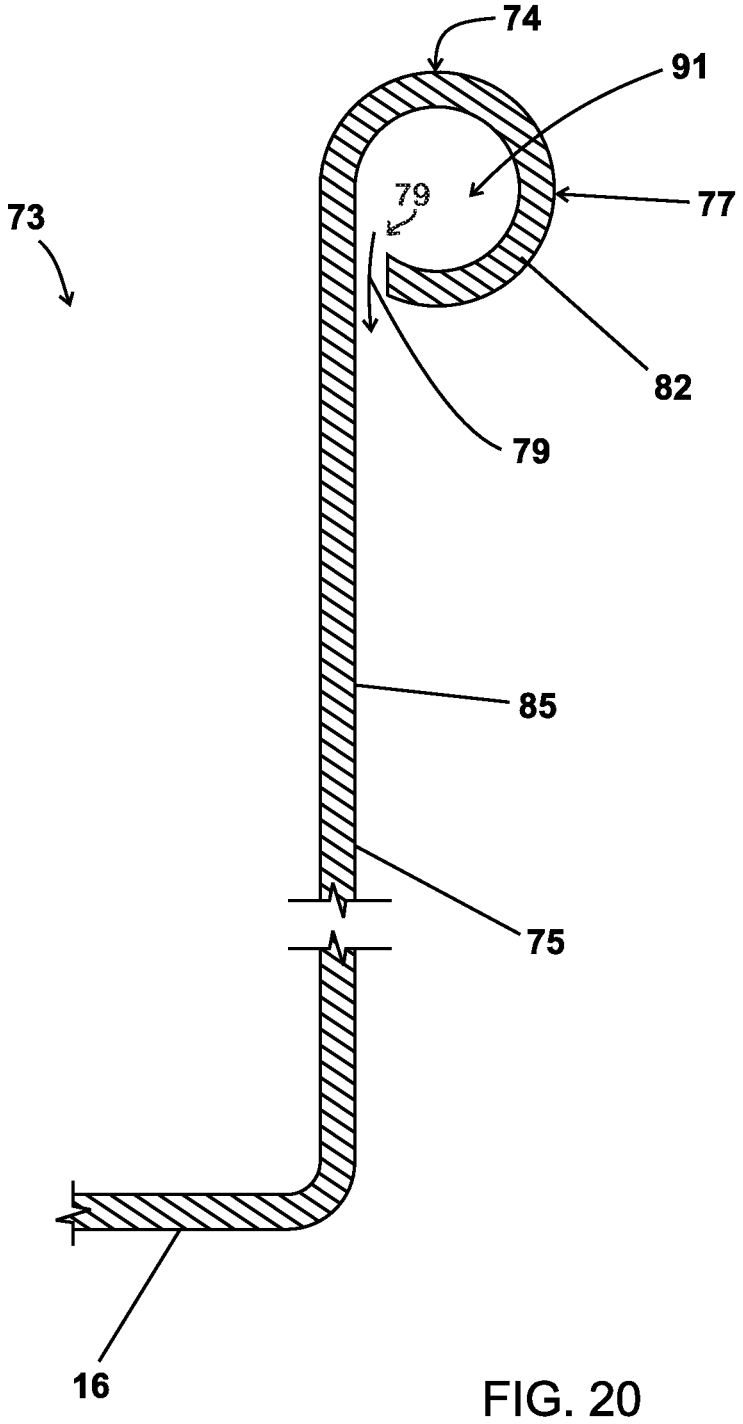
FIG. 20 is a sectional view taken along lines 20-20 of FIG. 17 and illustrating the pot rim rolled back against the pot side wall to create a bore for water, and having discharge openings.
Figure 21:
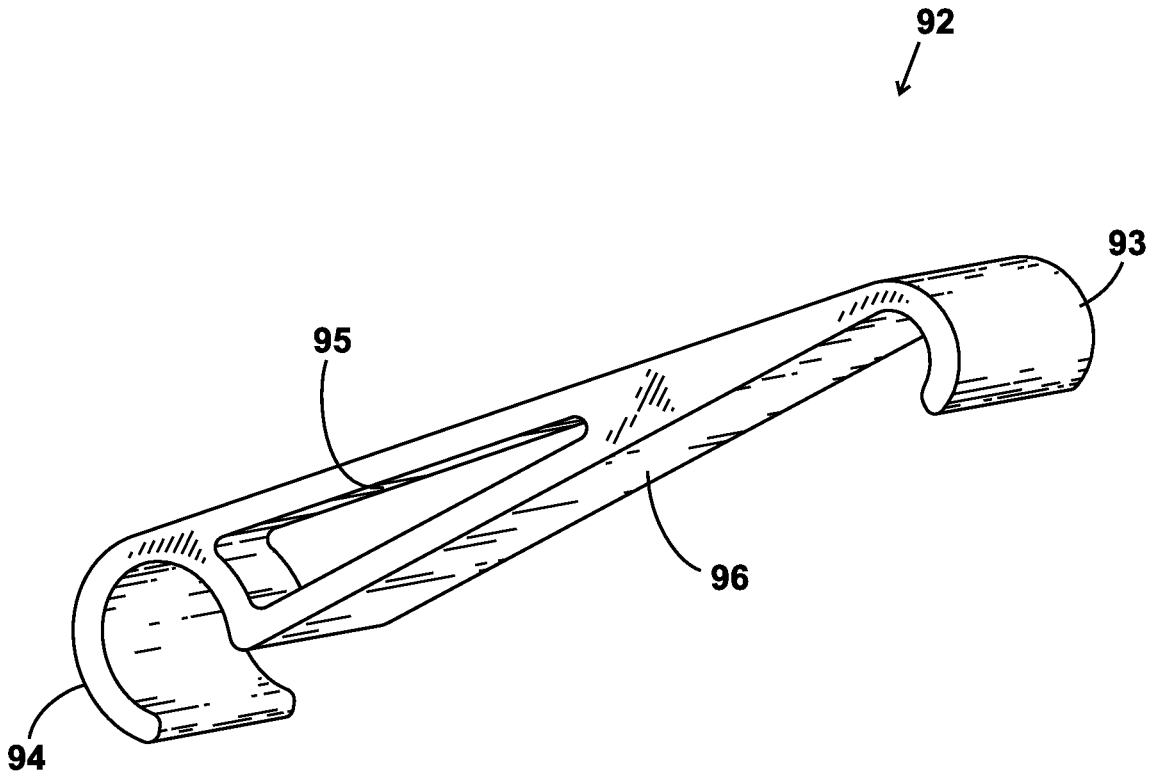
FIG. 21 is a perspective view of a bracket of the apparatus of the present invention.

FIGS. 17 and 20 show a fifth embodiment of the apparatus of the present invention, designated generally by the numeral 84. Outdoor cooking apparatus 84 has a spray ring 78 that is preferably directly abutting or closely spaced from pot 73 sidewall 75. Pot 73 has an upper pot rim 74 that is preferably in the form of an outwardly radially extending flange 82. The flange 82 can be semi-circular in radial cross section to provide a concave annular recess or channel 77. Channel 77 can contain a spray ring 78. Spray ring 78 can be connected to pot sidewall 75 with track welding, welding, adhesive or fasteners, for example. Spray ring 78 has discharge openings 79 that spray water directly upon the outside surface 85 of pot 73. Channel 77 can also be made by the pot rim 74 being rolled back against the pot 73 sidewall 75 to create a bore 91, as seen in FIG. 20. Bore 91 can contain the water for cooling the pot. Channel 77 including bore 91 has discharge openings 79 in the rolled section of the pot rim 74 that spray water directly upon the outside surface 85 of pot 73. The discharge openings 79 can be scalloped and can be located in the lower end of channel 77. Fitting 80 can provide an inflow channel 81 for conveying water to spray ring bore 83. Fitting 80 can provide a connection for enabling attachment to a hose, standard garden hose or the like.

Figure 19:
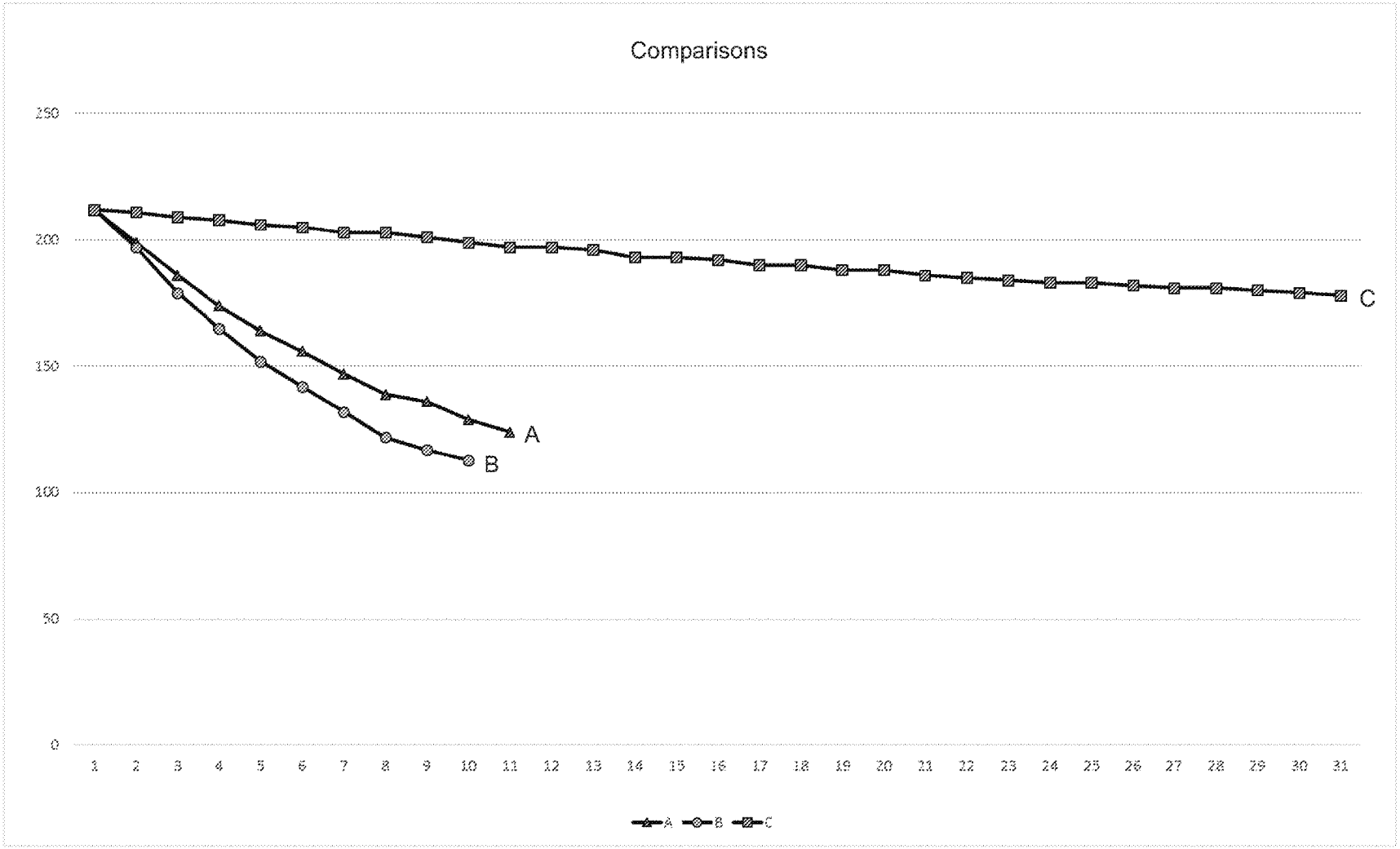
FIG. 19 is a graph showing a comparison of cooling the contents of a pot with the pot cooling apparatus of the present invention (such as a spray ring, manifold or header) and without the cooling apparatus.

The following table and FIG. 19 show a comparison of cooling the contents of a pot with a pot cooling apparatus of the present invention (such as a spray ring, manifold or header) and without the cooling apparatus. The data listed below was observed with a 100 quart pot and a flow rate of the spray water (i.e., city water) of about 5.5 gallons a minute. The table shows different temperatures of spray water (for example city water from a garden hose or well) being be supplied to a pot cooling apparatus and the time in minutes it takes to cool the contents of the cooking pot, compared to cooling the pot without a pot cooling apparatus.

| time (minutes) | A 79° F. city water temp (F.) | B 64° F. city water temp (F.) | C without pot cooling apparatus temp (F.) |
|---|---|---|---|
| 0 | 212 | 212 | 212 |
| 1 | 199 | 197 | 211 |
| 2 | 186 | 179 | 209 |
| 3 | 174 | 165 | 208 |
| 4 | 164 | 152 | 206 |
| 5 | 156 | 142 | 205 |
| 6 | 147 | 132 | 203 |
| 7 | 139 | 122 | 203 |
| 8 | 136 | 117 | 201 |
| 9 | 129 | 113 | 199 |
| 10 | 124 | | 197 |

-continued

| time (minutes) | A 79° F. city water temp (F.) | B 64° F. city water temp (F.) | C without pot cooling apparatus temp (F.) |
|---|---|---|---|
| 11 | | | 197 |
| 12 | | | 196 |
| 13 | | | 193 |
| 14 | | | 193 |
| 15 | | | 192 |
| 16 | | | 190 |
| 17 | | | 190 |
| 18 | | | 188 |
| 19 | | | 188 |
| 20 | | | 186 |
| 21 | | | 185 |
| 22 | | | 184 |
| 23 | | | 183 |
| 24 | | | 183 |
| 25 | | | 182 |
| 26 | | | 181 |
| 27 | | | 181 |
| 28 | | | 180 |
| 29 | | | 179 |
| 30 | | | 178 |

In one embodiment, a preferred temperature for the cooked food items is about 155 degrees-160 degrees F. At this temperature, the crawfish/crayfish or other food items can be easily handled for eating and they are not dried out.

For example, spray water at about 79 degrees F. cools the pot contents in less than 10 minutes from boiling temperature of about 212 degrees F. Spray water at about 64 degrees F. cools the pot contents in about 3-4 minutes from boiling temperature of about 212 degrees F.

The cooling process when using the cooling apparatus produces a temperature reduction from about 212 degrees F. to about 140-170 degrees F. in about 1-10 minutes, and more preferably to about 155-160 degrees F. in about 3-8 minutes.

Inflowing water temperature can be about 35-80 degrees F. and can cool from a temperature of about 212 degrees F. to 150-170 degrees, between about 1-10 minutes, more preferably about 2-8 minutes, and most preferably about 3-6 minutes.

It is preferable to cool the cooked food items to between 40-60 degrees below the boiling temperature of about 212 degrees in less than 10 minutes.

Figure 22:
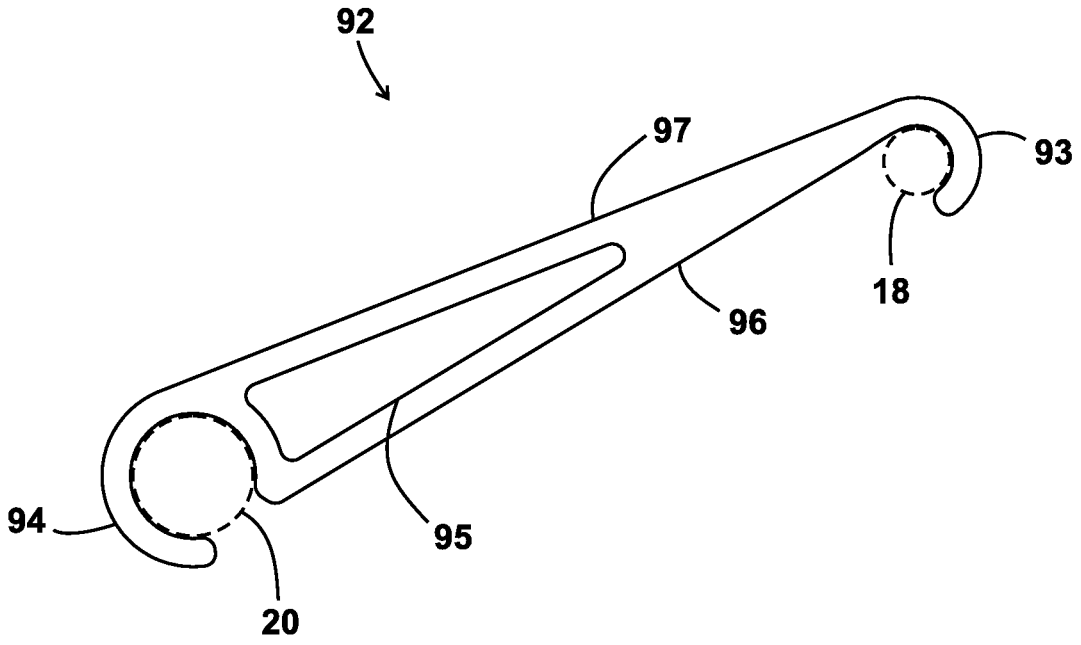
FIG. 22 is a side view of a bracket attached to the pot rim and spray ring of the apparatus of the present invention.
Figure 23:
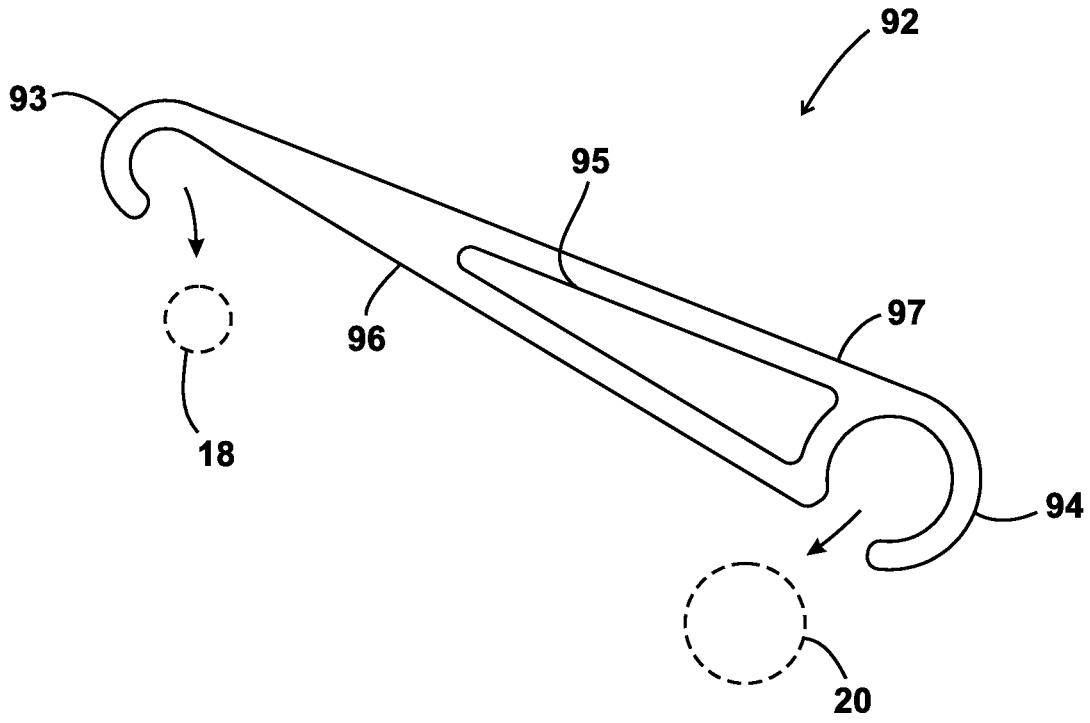
FIG. 23 is a side view of a bracket illustrating how the bracket attaches to the pot rim and spray ring of the apparatus of the present invention.
Figure 24:
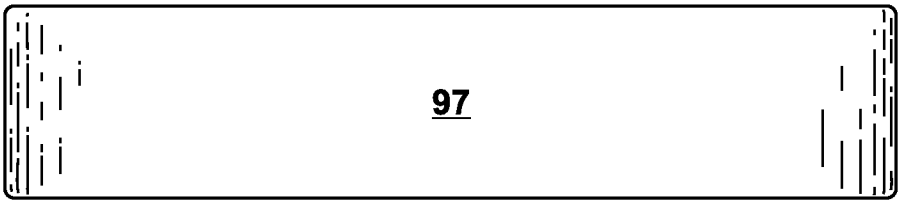
FIG. 24 is a top view of a bracket of the apparatus of the present invention.
Figure 25:
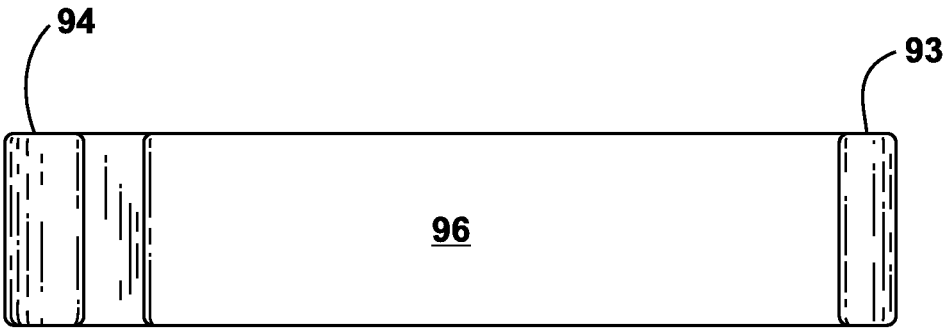
FIG. 25 is a bottom view of a bracket of the apparatus of the present invention.

FIGS. 21-26 show bracket 92 that can be used in an alternate embodiment of the apparatus of the present invention to attach to the pot rim 18 and spray ring 20. Each bracket 92 has clip 93 at one end and clip 94 at the other end. Bracket 92 has a top surface 97 and a bottom surface 96 with a space 95 in between top surface 97 and bottom surface 96. FIGS. 22 and 23 show how clip 93 of bracket 92 removably attaches to/snaps on pot rim 18 and clip 94 of bracket 92 removably attaches to/snaps on spray ring 20. Clip 94 can extend between about 180-270 degrees around. Clip 93 can extend about 180 degrees around. Clip 93 can extend more or less than about 180 degrees around. Clip 93 is configured to rest on pot rim 18.

Figure 26:
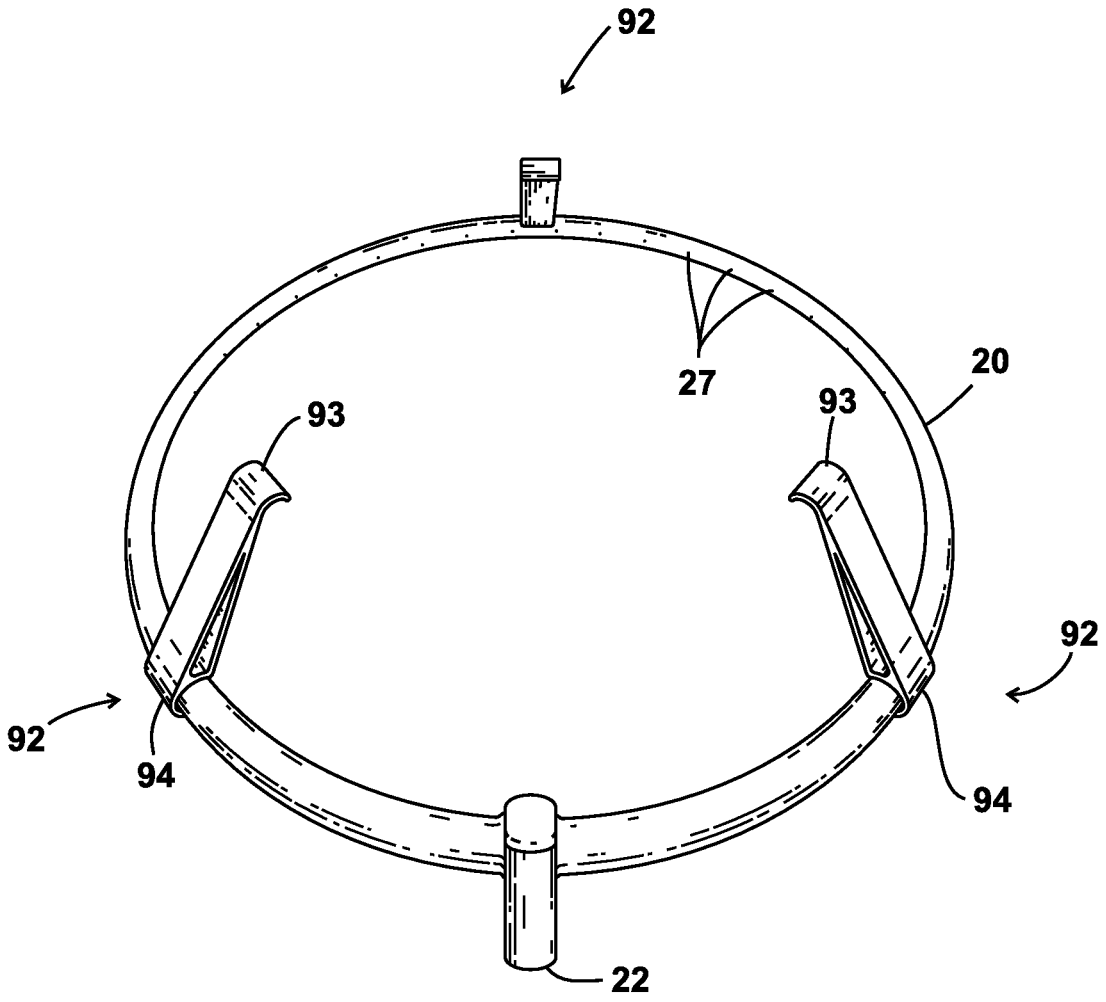
FIG. 26 is a perspective view of brackets on the ring of the apparatus of the present invention.

Bracket 92 preferably does not require fasteners to attach to or maintain a snug fit with pot rim 18 and spray ring 20. Additionally, clips 93, 94 allow for bracket 92 to preferably pivot without losing position or losing the snug fit on pot rim 18 and spray ring 20. FIG. 26 shows brackets 92 attached to/clipped on spray ring 20 via clips 94. Brackets 92 are non-marring and do not scratch the finish on spray ring 20 when the brackets 92 are removed.

The following is a list of parts and materials suitable for use in the present invention:

PARTS LIST

| PART NUMBER | DESCRIPTION |
|---|---|
| 10 | outdoor cooking apparatus |
| 11 | base/burner apparatus |
| 12 | leg |
| 13 | foot |
| 14 | pot support |
| 15 | pot |
| 16 | pot bottom panel |
| 17 | pot side wall |
| 18 | pot rim |
| 19 | pot opening/open top |
| 20 | spray ring |
| 20A | spray ring |
| 20B | spray ring |
| 21 | fitting/tee |
| 22 | inflow fitting |
| 23 | connector/connection threaded connection |
| 24 | burner element |
| 25 | bend |
| 26 | straight section |
| 27 | water spray opening |
| 28 | water spray stream |
| 29 | pot liner/basket |
| 30 | handle |
| 31 | liner/basket opening |
| 32 | radially extending support |
| 33 | inner end portion |
| 34 | hook/curved portion |
| 35 | outer end portion |
| 36 | clamp |
| 37 | end |
| 38 | bend |
| 39 | bolted connection |
| 40 | pot outer surface |
| 41 | cooking apparatus |
| 42 | base |
| 43 | leg |
| 44 | foot |
| 45 | spray ring |
| 46 | radially extending support |
| 47 | discharge opening |
| 48 | water stream |
| 49 | fitting |
| 50 | cooking apparatus |
| 51 | hose |
| 52 | base |
| 53 | burner element |
| 54 | leg |
| 55 | spray ring |
| 56 | attachment |
| 57 | water spray stream |
| 58 | pot support/grate |
| 59 | foot/feet |
| 60 | fitting |
| 61 | outdoor cooking apparatus |
| 62 | base |
| 63 | burner element |
| 64 | leg |
| 65 | foot |
| 66 | pot support |
| 67 | header |
| 68 | discharge opening |
| 69 | fitting/tee |
| 70 | water spray stream |
| 71 | header side wall |
| 72 | internal bore |
| 73 | pot |
| 74 | pot rim |
| 75 | pot sidewall |
| 76 | pot interior |
| 77 | recess/channel |
| 78 | spray ring |

-continued

| PART NUMBER | DESCRIPTION |
|---|---|
| 79 | discharge opening |
| 80 | fitting |
| 81 | inflow channel |
| 82 | flange outside surface |
| 83 | spray ring bore |
| 84 | outdoor cooking apparatus |
| 85 | outside surface |
| 90 | arrow |
| 91 | bore |
| 92 | bracket |
| 93 | clip |
| 94 | clip |
| 95 | space |
| 96 | bottom surface |
| 97 | top surface |

All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

The invention claimed is:

1. An outdoor cooking apparatus, comprising:

a) a base that has a burner element and one or more feet configured to engage an underlying support surface;

b) the base including a pot receptive grate;

c) a pot having a pot rim, a pot outer surface, a pot interior for holding a volume of cooking fluid;

d) a water spray ring with a hollow ring bore, a ring wall, and multiple discharge openings in said ring wall;

e) an inlet fitting that enables connection of a flowing source of water to said ring bore;

f) wherein said ring is so positioned that food items can be removed from the pot interior without first moving the ring;

g) multiple radially extending, circumferentially spaced apart ring supports that attach to the ring and to the pot rim at multiple spaced apart positions;

h) each support having a first end portion with a clip that enables removable attachment to the ring and a second end portion with a concave coupler that registers on the pot rim during rinse;

i) wherein each said support is pivotally attached to the ring; and j) wherein the concave coupler is configured to pivot upon the pot rim when a said ring support is rotated, enabling connection to pots of differing diameters, wherein each ring support pivots relative to both the pot rim and the spray ring during rotation of the ring support relative to the pot.

2. The outdoor cooking apparatus of claim 1 wherein the ring is sized and shaped to attach to pots of differing diameters and by pivoting the supports.

3. The outdoor cooking apparatus of claim 2 wherein each support extends between the pot rim and the ring at different angular positions for connecting to pots of differing diameters.

4. The outdoor cooking apparatus of claim 3 wherein the supports are rotatably attached to the ring so that the ring can be adjustably fitted to pots of different diameters.

5. The outdoor cooking apparatus of claim 1 wherein the ring extends three hundred sixty degrees around the pot during use.

6. The outdoor cooking apparatus of claim 1 wherein the ring tracks a circular path.

7. The outdoor cooking apparatus of claim 1 wherein the ring has a polygonal shape.

8. The outdoor cooking apparatus of claim 1 wherein the discharge openings are positioned to spray water upon the pot outer surface.

9. An outdoor cooking apparatus, comprising:

a) a base that has a burner element and one or more feet configured to engage an underlying support surface;

b) the base including a pot receptive grate;

c) a pot having a pot rim, one or more pot side walls, a pot bottom, a pot outer surface, a pot interior for holding a volume of cooking fluid and a removable basket that fits the pot interior;

d) multiple holders that support a fluid conveying spray header that has a header wall, a header flow conveying bore, and multiple discharge openings in said header wall, each holder pivotally attached to said header;

e) an inlet fitting that enables connection of a flowing source of water to said header bore;

f) wherein said header is so positioned that food items or the basket can be removed from the pot interior without first moving the header;

g) wherein there are three said holders, one said holder spaced circumferentially opposite said inlet fitting and two said holders are spaced less than (90) degrees from said inlet fitting.

10. The outdoor cooking apparatus of claim 9 wherein the header is attached to the base.

11. The outdoor cooking apparatus of claim 9 wherein the header extends to around 360°.

12. The outdoor cooking apparatus of claim 9 wherein the header is positioned below the pot.

13. The outdoor cooking apparatus of claim 9 wherein the header tracks a circular path.

14. The outdoor cooking apparatus of claim 11 wherein the header is entirely below the pot.

15. The outdoor cooking apparatus of claim 11 wherein the header is positioned to spray the pot side wall or walls.

16. The outdoor cooking apparatus of claim 11 wherein the header is positioned to spray the pot bottom.

17. A cooking pot cooling apparatus, comprising:

a) a holder that supports a manifold next to a pot, the pot having one or more side walls, a pot rim, a pot bottom, and an interior for holding a volume of cooking fluid;

b) the manifold having discharging openings that direct water spray next to the pot;

c) an inlet fitting on said manifold that enables connection of a flowing source of water to said manifold;

d) wherein said manifold is so positioned that food items can be removed from the pot interior without first moving the manifold;

e) wherein the holder comprises multiple radially extending, circumferentially spaced apart manifold supports that attach to the manifold and to the pot rim at multiple spaced apart positions;

f) each support having a first end portion with a clip that enables removable attachment to the manifold and a second end portion with a concave coupler that registers on the pot rim during use rinse, g) wherein each said support is pivotally attached to the manifold; and h) wherein the concave coupler is configured to pivot upon the pot rim when a said support is rotated for connecting to pots of differing diameters, wherein each support pivots relative to both the pot rim and the manifold during rotation of the support relative to the pot.

18. The cooking pot cooling apparatus of claim 17, wherein the holder comprises at least three radially extending supports that extend between the pot rim and the manifold.

19. The cooking pot cooling apparatus of claim 17 wherein the supports are rotatably attached to the manifold so that the manifold can be adjustably fitted to pots of different diameters.

20. The cooking pot cooling apparatus of claim 17 wherein the manifold extends three hundred sixty degrees around the pot during use.

21. The cooking pot cooling apparatus of claim 17 wherein the manifold has a polygonal shape.

22. The cooking pot cooling apparatus of claim 17 wherein the manifold has a square shape.

23. The cooking pot cooling apparatus of claim 17 wherein the manifold is positioned to spray the pot bottom.

24. The outdoor cooking apparatus of claim 1 wherein the temperature of the cooking fluid drops from about 212 degrees F. to between about 140-175 degrees F. in a time period of about 1-10 minutes.

25. The outdoor cooking apparatus of claim 9 wherein the temperature of the cooking fluid drops from about 212 degrees F. to between about 155-160 degrees F. in a time period of about 3-6 minutes.

26. The cooking pot cooling apparatus of claim 17, wherein the clip end portion that attaches to the manifold extends more than about 180 degrees around.

27. An outdoor cooking apparatus, comprising:

a) a base that has a burner element and one or more feet configured to engage an underlying support surface, the base including a pot receptive grate;

b) a pot having a pot rim, one or more pot side walls, a pot outer surface, a pot interior for holding a volume of cooking fluid;

c) the pot rim having a radially extending flange that provides a flow conveying bore and multiple discharge openings at the lower end of said flange;

d) an inlet fitting that enables connection of a flowing source of water to said flow conveying bore;

e) wherein the discharge openings spray water directly on the pot outer surface.

28. The outdoor cooking apparatus of claim 27, wherein the pot rim is rolled back against the pot side walls.

29. The outdoor cooking apparatus of claim 27, wherein the discharge openings are scalloped openings.

30. The outdoor cooking apparatus of claim 27, wherein the flange is semi-circular in cross section.

31. The outdoor cooking apparatus of claim 27, wherein the flange is a tube.

32. An outdoor cooking apparatus, comprising:

a) a base that has a burner element and one or more feet configured to engage an underlying support surface, the base including a pot receptive grate;

b) a pot having a pot rim, one or more pot side walls, a pot bottom, a pot outer surface, a pot interior for holding a volume of cooking fluid;

c) that base including a holder that supports a fluid conveying spray header that has a header wall, a header flow conveying bore, and multiple discharge openings in said header wall;

d) an inlet fitting that enables connection of a flowing source of water to said header bore; and e) wherein said header is so positioned that food items can be removed from the pot interior without first moving the header.

33. The outdoor cooking apparatus of claim 32 wherein the header extends around the pot side wall or walls.

34. The outdoor cooking apparatus of claim 32 wherein the header is positioned below the pot.

35. The outdoor cooking apparatus of claim 32 wherein the header tracks a circular path.

36. The outdoor cooking apparatus of claim 32 wherein the header is entirely below the pot.

37. The outdoor cooking apparatus of claim 32 wherein the header is positioned to spray the pot bottom.

38. The outdoor cooking apparatus of claim 32 wherein the header is positioned to spray the pot bottom.

39. The outdoor cooking apparatus of claim 1 wherein there are three said ring supports, one said ring support spaced circumferentially opposite said inlet fitting and two said ring supports are spaced less than ninety (90) degrees from said inlet fitting.

40. The cooking pot cooling apparatus of claim 17 wherein there are three said supports, one said support spaced circumferentially opposite said inlet fitting and two said supports are spaced less than ninety (90) degrees from said inlet fitting.

* * * * *